US005704066A

United States Patent [19]

Yamamoto

[11] Patent Number: 5,704,066

[45] Date of Patent: Jan. 6, 1998

[54] PROTECTIVE GLOVE DEVICE

[76] Inventor: Paul Kiyoshi Yamamoto, 766 Ilaniwai St., Honolulu, Hi. 96813

[21] Appl. No.: 726,054

[22] Filed: Sep. 27, 1996

[51] Int. Cl.[6] ..... A41D 19/00

[52] U.S. Cl. ..... 2/161.6; 2/160; 2/167

[58] Field of Search ..... 2/160, 161.6, 167

[56] References Cited

U.S. PATENT DOCUMENTS

| | | | |
|---|---|---|---|
| 4,670,909 | 6/1987 | Forrester | 2/160 |
| 4,791,682 | 12/1988 | Herr et al. | 2/160 |
| 4,862,521 | 9/1989 | Mann | 2/160 |
| 5,088,123 | 2/1992 | MacDonald | 2/161.6 |
| 5,511,241 | 4/1996 | Ziegler | 2/161.6 |

FOREIGN PATENT DOCUMENTS

| | | | |
|---|---|---|---|
| 23689 | 12/1914 | United Kingdom | 21/161.1 |
| 468296 | 7/1937 | United Kingdom | 2/160 |
| 2092434 | 8/1982 | United Kingdom | 2/160 |
| 2241869 | 9/1991 | United Kingdom | 2/160 |

*Primary Examiner*—Bibhu Mohanty

*Attorney, Agent, or Firm*—Michael I. Kroll

[57] ABSTRACT

A protective device (10) comprising a glove (12) constructed of an electrically conductive material (14) to be worn on a hand (16) of a person (18). A structure (20) is for grounding the glove (12). Spark plug wires (22) in an engine (24) of a motor vehicle (26) can be handled by the person (18) without danger of electrical shock. This will also minimize damage to an ignition module and/or distributor components (28) by grounding high voltage from a coil (30) in the engine (24) of the motor vehicle (26).

23 Claims, 4 Drawing Sheets

PROTECTIVE GLOVE DEVICE

BACKGROUND OF THE INVENTION

1. Field of the Invention

The instant invention relates generally to gloves and more specifically it relates to a protective device.

2. Description of the Prior Art

Numerous gloves have been provided in prior art. For example, U.S. Pat. Nos. 2,516,241 to Mulheran; 4,004,295 to Byrnes, Sr. and 4,862,521 to Mann all are illustrative of such prior art. While these units may be suitable for the particular purpose to which they address, they would not be as suitable for the purposes of the present invention as heretofore described.

MULHERAN, MARJORIE K.

GLOVE

U.S. Pat. No. 2,516,241

In combination, a pair of gloves having respective slide fastener mechanisms including a runner carried by each glove. A hooklike clasp is carried by each of the runners. The clasps are mutually engageable to maintain the pair of gloves as a unit. Each of the hooklike clasps comprises a resilient strip, reversely bent to form two loops having oppositely disposed entrance sections. One of the loops is secured to a respective runner. The finger piece is secured to the other of the loops.

BYRNES, SR., ROBERT M.

PROTECTIVE GLOVE CONSTRUCTED OF FLEXIBLE STRANDS OF METAL WIRE AND FIBER YARN

U.S. Pat. No. 4,004,295

A protective glove for use by persons engaged in various operations in meat packing or processing plants, such as an operator who uses a knife during various meat cutting procedures in which one hand usually holds the knife and manipulates it adjacent the other hand or other portions of the body which frequently results in accidental injury. The glove is constructed from a flexible fiber and a small wire fiber combined in a conventional manner of constructing gloves with the non-metallic fiber preferably being an aramid fiber having unique properties advantageously employed in such articles of manufacture with the fiber being manufactured by the DuPont Company of Wilmington, Del., under the trademark KEVLAR. The metallic wire fiber or strands are flexible, quite strong and materially strengthens the glove and renders it more durable and aids in preventing penetration of the glove by a knife blade or the like. The glove is of light-weight construction and may be provided with various wrist lengths and without straps or buckles, thereby eliminating failure of such items and the tendency of such items to catch on various machines and the like.

MANN, KEVIN D.

WATCH SUPPORTING, PROTECTING AND INSULATING DEVICE

U.S. Pat. No. 4,862,521

A watch supporting, protecting and insulating device, wherein, a glove has a pocket, which retains and protects a timepiece, permits viewing of the timepiece, and facilitates storage of other articles in the pocket.

SUMMARY OF THE INVENTION

A primary object of the present invention is to provide a protective device that will overcome the shortcomings of the prior art devices.

Another object is to provide a protective device which is a stainless steel wire mesh glove connected by a wire clip to an alligator clip, wherein grounding the alligator clip to the chassis of a motor vehicle will allow spark plug wires to be handled safely without danger of electrical shock to a person wearing the protective device on the hand.

An additional object is to provide a protective device that will minimize damage to ignition modules and/or distributor components by grounding high voltage from the coil in the motor vehicle.

A further object is to provide a protective device that is simple and easy to use.

A still further object is to provide a protective device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
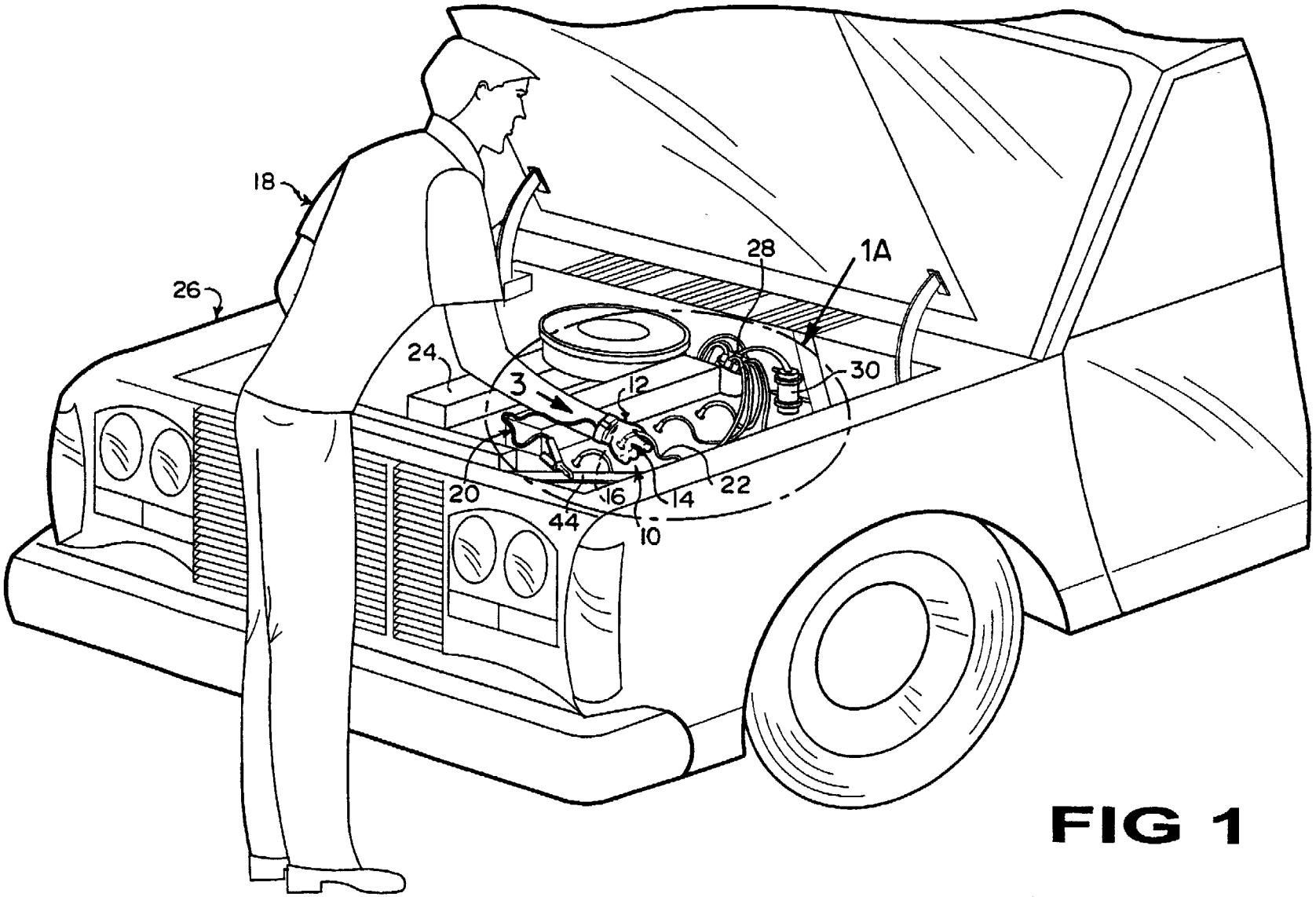
FIG. 1 is a perspective view of the instant invention in use.
Figure 1A:
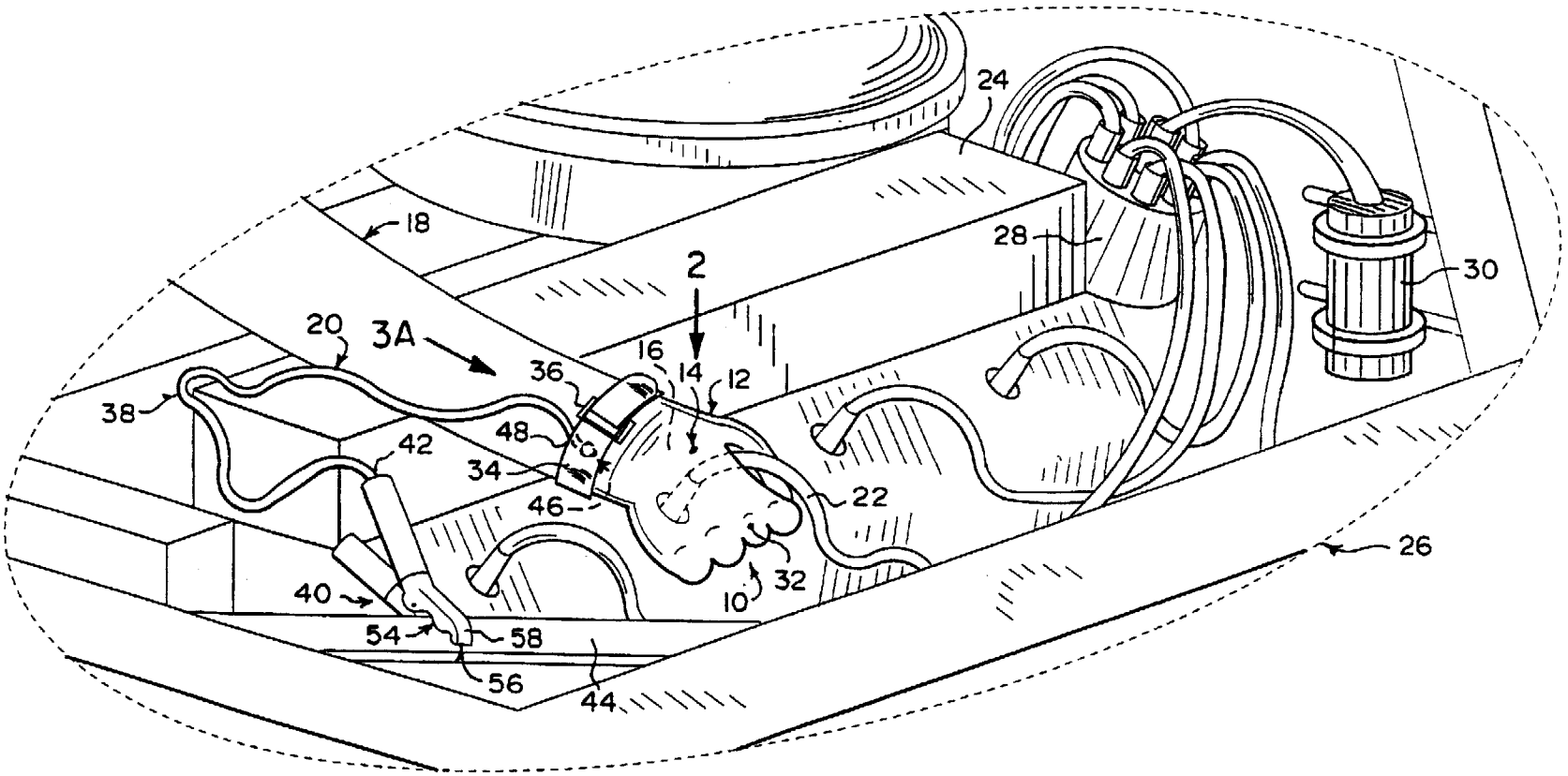
FIG. 1A is an enlarged perspective view of the area indicated by arrow 1A in FIG. 1.
Figure 2:
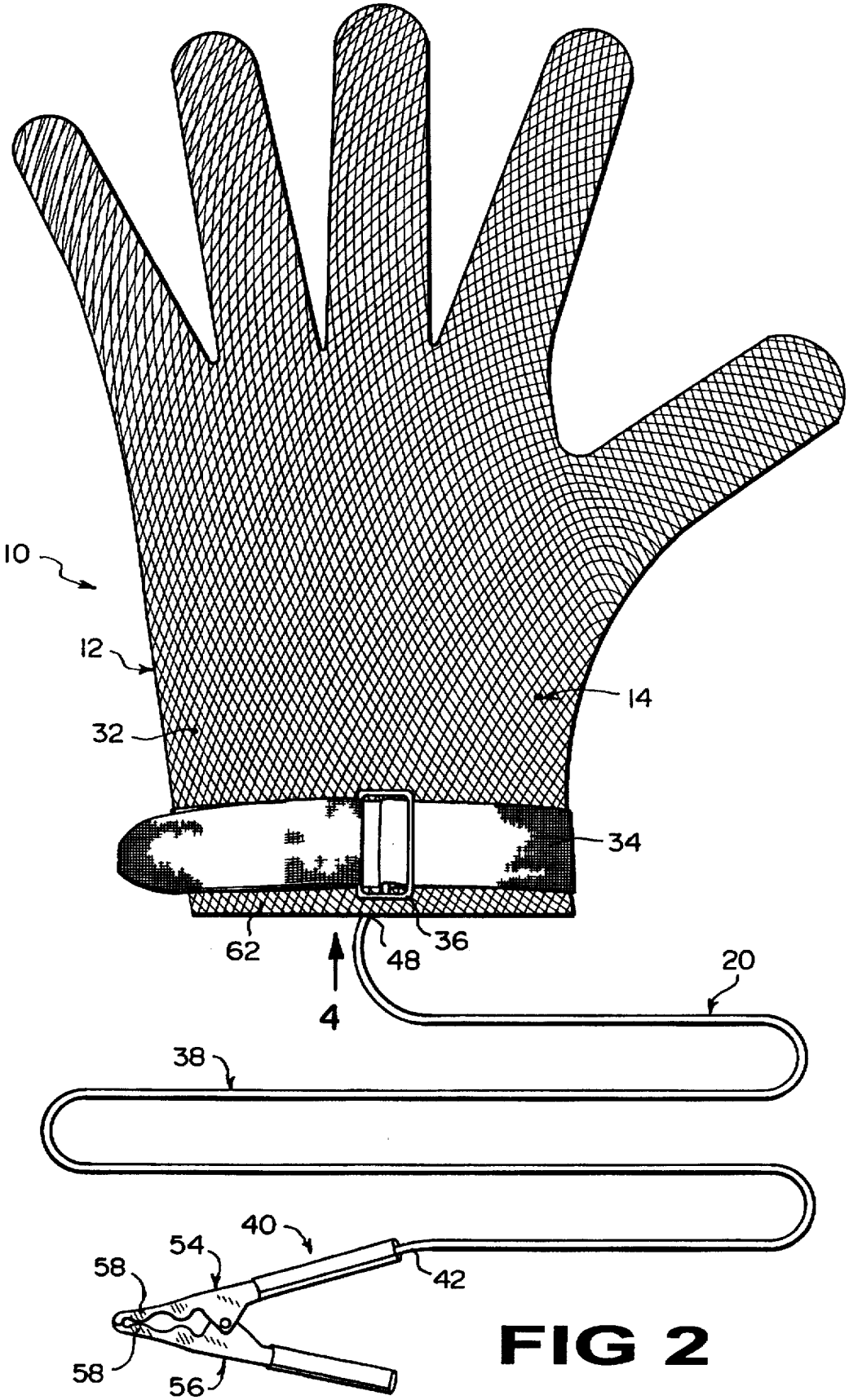
FIG. 2 is a further enlarged top view taken in the direction of arrow 2 in FIG. 1A of the instant invention per se.

Turning now descriptively to the drawings, in which similar reference characters denote similar elements throughout the several views, FIGS. 1 and 2 illustrate a protective device 10 comprising a glove 12 constructed of an electrically conductive material 14 to be worn on a hand 16 of a person 18. A structure 20 is for grounding the glove 12. Spark plug wires 22 in an engine 24 of a motor vehicle 26 can be handled by a person 18, without danger of electrical shock. This will also minimize damage to an ignition module and/or distributor components 28, by grounding high voltage from a coil 30 in the engine 24 of the motor vehicle 26.

The electrically conductive material 14 is a stainless steel wire mesh 32. The glove 12 includes a wrist strap 34 with a buckle 36, so as to maintain the glove 12 snugly upon the hand 16 of the person 18.

The grounding structure 20 consists of an elongated wire 38. A component 40 is for electrically attaching in a removable manner a first end 42 of the elongated wire 38 to a metal framework 44 of the motor vehicle 26. A facility 46 is for electrically attaching in a permanent manner a second end 48 of the elongated wire 38 to the glove 12.

Figure 3:
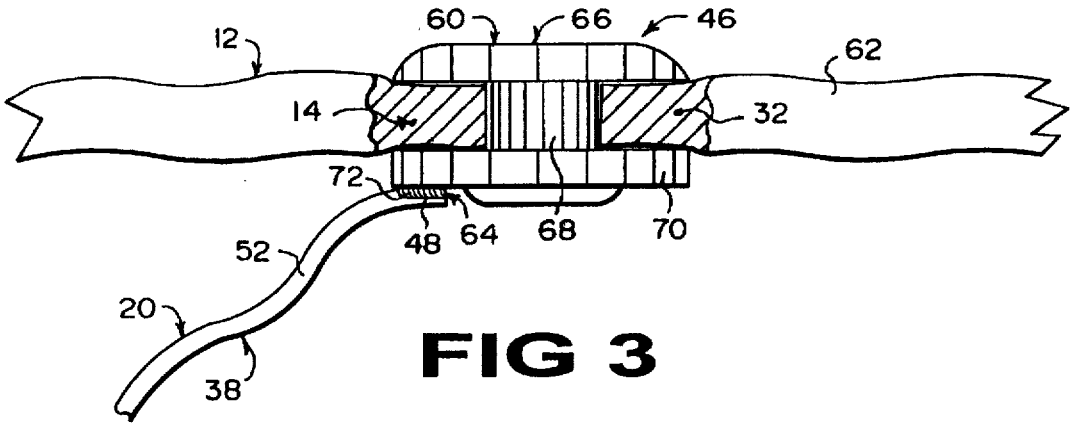
FIG. 3 is an enlarged side elevational view taken in the direction of arrow 3 in FIG. 1 with parts broken away and in section, showing a first type of wire connector.
Figure 3A:
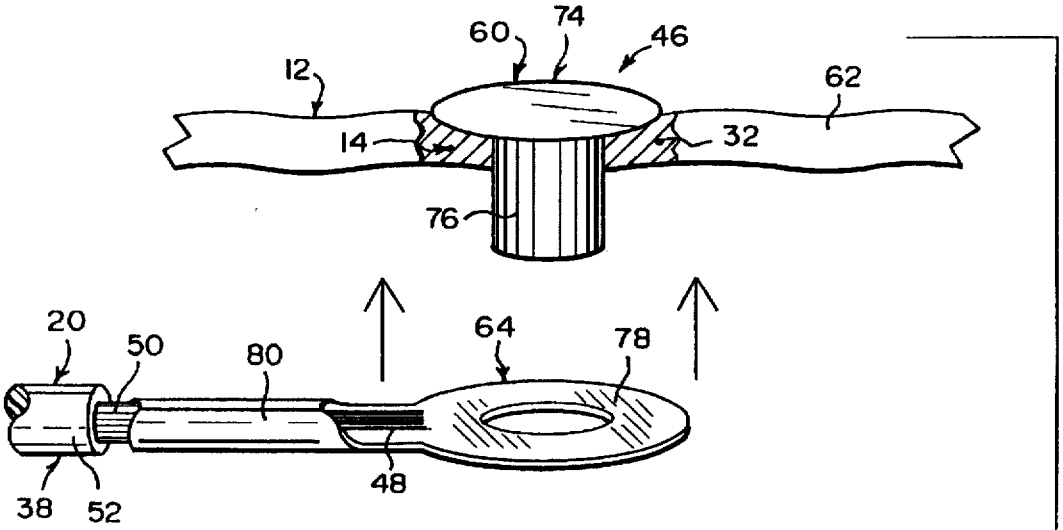
FIG. 3A is an enlarged exploded side perspective view taken in the direction of arrow 3A in FIG. 1A with parts broken away and in section, showing a second type of wire connector.

As best seen in FIG. 3A, the elongated wire 38 comprises a stranded group of solid cylindrical conductors 50, having a low resistance to current flow. An insulated sleeve 52 is over the stranded group of solid cylindrical conductors 50.

The electrically attaching component 40 is an alligator clip 54 affixed to the first end 42 of the elongated wire 38. The alligator clip 54 is a spring-loaded metal clamp 56, with a pair of long, narrow meshing jaws 58 that are used for making a temporary electrical connection to the metal framework 44 of the motor vehicle 26.

The electrically attaching facility 46 includes a fastener 60 connected to a wrist cuff portion 62 of the glove 12. An element 64 is for affixing the second end 48 of the elongated wire 38 to the fastener 60.

As best seen in FIG. 3, the fastener 60 consists of a rivet 66 having a shank 68 extending through the wrist cuff portion 62 of the glove 12. A washer 70 is on the shank 68 and is secured by the rivet 66 to the wrist cuff portion 62 of the glove 12. The affixing element 64 is solder 72 applied between the second end 48 of the elongated wire 38 and the washer 70.

As best seen in FIG. 3A, the fastener 60 comprises a rivet 74 having a shank 76 extending through the wrist cuff portion 62 of the glove 12. The affixing element 64 is a lug terminal 78 crimped at 80 onto the second end 48 of the elongated wire 38. The lug terminal 78 can be attached to the shank 76 of the rivet 74, up against the wrist cuff portion 62 of the glove 12.

Figure 4:
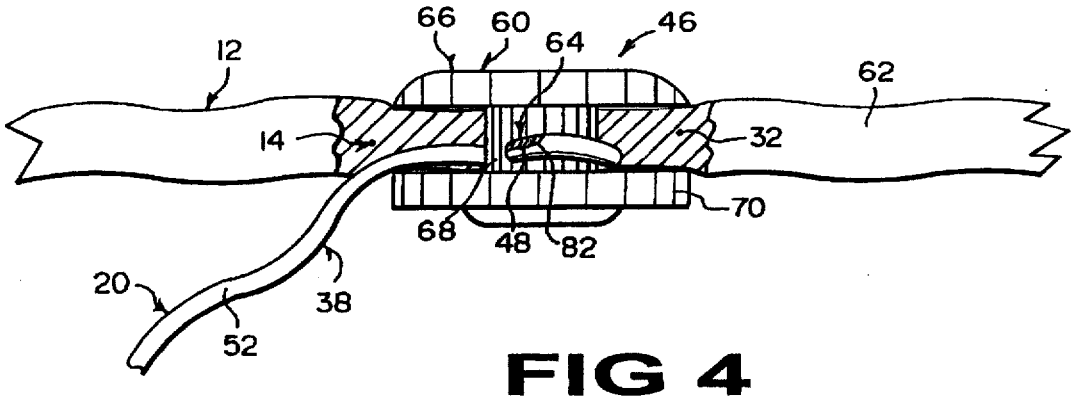
FIG. 4 is an enlarged side elevational view taken in the direction of arrow 4 in FIG. 2 with parts broken away and in section, showing a third type of wire connector.

In FIG. 4, the fastener 60 is identical to the fastener 60 in FIG. 3. The affixing element 64 is the second end 48 of the elongated wire 38 bent around and connected with solder 82, to the shank 68 of the rivet 66 between the washer 70 and the wrist cuff portion 62 of the glove 12.

OPERATION OF THE INVENTION

To use the protective device 10, the following steps should be taken:

1. Insert the hand 16 of the person 18 into the glove 12.
2. Squeeze the long narrow meshing jaws 58 of the spring-loaded metal clamp 56 apart on the elongated wire 38 connected to the glove 12.
3. Place the long narrow meshing jaws 58 between a portion of the metal framework 44 of the motor vehicle 26.
4. Release the long narrow meshing jaws 58, so that they contact the metal framework 44 of the motor vehicle 26.
5. Grasp the spark plug wires 22 of the engine 24 with the glove 12, to eliminate the danger of electrical shock and to minimize damage to the ignition module and/or distributor components 28, by grounding the high voltage from the coil 30 in the engine 24 of the motor vehicle 26.

LIST OF REFERENCE NUMBERS

10 protective device
12 glove of 10
14 electrically conductive material of 12
16 hand of 18
18 person
20 grounding structure of 10
22 spark plug wire of 24
24 engine in 26
26 motor vehicle
28 distributor components of 24
30 coil of 24
32 stainless steel wire mesh for 14
34 wrist strap on 12
36 buckle on 34
38 elongated wire of 20
40 electrically attaching component of 20
42 first end of 38
44 metal framework of 26
46 electrically attaching facility of 20
48 second end of 38
50 stranded group of solid cylindrical conductors of 38
52 insulated sleeve of 38
54 alligator clip of 40
56 spring-loaded metal clamp for 54
58 long narrow meshing jaw of 56
60 fastener of 46
62 wrist cuff portion of 12
64 affixing element of 46
66 rivet of 60
68 shank of 66
70 washer of 60
72 solder for 64
74 rivet of 60
76 shank of 74
78 lug terminal of 64
80 crimp of 78
82 solder for 64

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A protective device comprising:

a) a glove constructed of an electrically conductive material to be worn on a hand of a person; and b) means for grounding said glove, so that spark plug wires in an engine of a motor vehicle can be handled by the person without danger of electrical shock, and to minimize damage to an ignition module and/or distributor components by grounding high voltage from a coil in the engine of the motor vehicle, said grounding means including:

i) an elongated wire having a stranded group of solid cylindrical conductors having a low resistance to current flow and an insulated sleeve over said stranded group of solid cylindrical conductors:

ii) means for electrically attaching in a removable manner a first end of said elongated wire to a metal framework of the motor vehicle; and iii) means for electrically attaching in a permanent manner a second end of said elongated wire to said glove.

2. A protective device as recited in claim 1, wherein said electrically conductive material is a stainless steel wire mesh.

3. A protective device as recited in claim 1, wherein said glove includes a wrist strap with a buckle, so as to maintain said glove snugly upon the hand of the person.

4. A protective device as recited in claim 1, wherein said first attaching means is an alligator clip affixed to said first end of said elongated wire, said alligator clip being a spring-loaded metal clamp with a pair of long, narrow meshing jaws that are used for making a temporary electrical connection to the metal framework of the motor vehicle.

5. A protective device as recited in claim 1, wherein said second attaching means includes:

a) a fastener connected to a wrist cuff portion of said glove; and b) means for affixing said second end of said elongated wire to said fastener.

6. A protective device as recited in claim 5, wherein said fastener includes:

a) a rivet having a shank extending through said wrist cuff portion of said glove; and b) a washer on said shank and secured by said rivet to said wrist cuff portion of said glove.

7. A protective device as recited in claim 6, wherein said affixing means is solder applied between said second end of said elongated wire and said washer.

8. A protective device as recited in claim 5, wherein said fastener includes a rivet having a shank extending through said wrist cuff portion of said glove.

9. A protective device as recited in claim 8, wherein said affixing means is a lug terminal crimped onto said second end of said elongated wire, so that said lug terminal can be attached to said shank of said rivet, up against said wrist cuff portion of said glove.

10. A protective device as recited in claim 6, wherein said affixing means is said second end of said elongated wire bent around and connected with solder to said shank of said rivet between said washer and said wrist cuff portion of said glove.

11. A protective device as recited in claim 2, wherein said glove includes a wrist strap with a buckle, so as to maintain said glove snugly upon the hand of the person.

12. A protective device as recited in claim 11, wherein said first attaching means is an alligator clip affixed to said first end of said elongated wire, said alligator clip being a spring-loaded metal clamp with a pair of long, narrow meshing jaws that are used for making a temporary electrical connection to the metal framework of the motor vehicle.

13. A protective device as recited in claim 12, wherein said second attaching means includes:

a) a fastener connected to a wrist cuff portion of said glove; and b) means for affixing said second end of said elongated wire to said fastener.

14. A protective device as recited in claim 13, wherein said fastener includes:

a) a rivet having a shank extending through said wrist cuff portion of said glove; and b) a washer on said shank and secured by said rivet to said wrist cuff portion of said glove.

15. A protective device as recited in claim 14, wherein said affixing means is solder applied between said second end of said elongated wire and said washer.

16. A protective device as recited in claim 13, wherein said fastener includes a rivet having a shank extending through said wrist cuff portion of said glove.

17. A protective device as recited in claim 16, wherein said affixing means is a lug terminal crimped onto said second end of said elongated wire, so that said lug terminal can be attached to said shank of said rivet, up against said wrist cuff portion of said glove.

18. A protective device as recited in claim 14, wherein said affixing means is said second end of said elongated wire bent around and connected with solder to said shank of said rivet between said washer and said wrist cuff portion of said glove.

19. A protective device comprising:

a) a glove constructed of an electrically conductive material to be worn on a hand of a person; and b) means for grounding said glove, so that spark plug wires in an engine of a motor vehicle can be handled by the person without danger of electrical shock, and to minimize damage to an ignition module and/or distributor components by grounding high voltage from a coil in the engine of the motor vehicle, said grounding means including:

i) an elongated wire;

ii) means for electrically attaching in a removable manner a first end of said elongated wire to a metal framework of the motor vehicle; and iii) means for electrically attaching in a permanent manner a second end of said elongated wire to said glove, said second attaching means including a fastener connected to a wrist cuff portion of said glove and means for affixing said second end of said elongated wire to said fastener, said fastener including a rivet having a shank extending through said wrist cuff portion of said glove.

20. A protective device as recited in claim 19, wherein said fastener further comprises a washer on said shank and secured by said rivet to said wrist cuff portion of said glove.

21. A protective device as recited in claim 20, wherein said affixing means is solder applied between said second end of said elongated wire and said washer.

22. A protective device as recited in claim 19, wherein said affixing means is a lug terminal crimped onto said second end of said elongated wire, so that said lug terminal can be attached to said shank of said rivet, up against said wrist cuff portion of said glove.

23. A protective device as recited in claim 20, wherein said affixing means is said second end of said elongated wire bent around and connected with solder to said shank of said rivet between said washer and said wrist cuff portion of said glove.

* * * * *